US005944232A

United States Patent [19]

Hestehave et al.

[11] Patent Number: 5,944,232

[45] Date of Patent: Aug. 31, 1999

[54] WATER BOTTLE FOR WATER COOLER TYPE DISPENSING APPARATUS

[75] Inventors: Borge Hestehave, Alta Loma; Kjeld Hestehave, Upland, both of Calif.

[73] Assignee: Bomatic, Inc., Ontario, Calif.

[21] Appl. No.: 08/812,452

[22] Filed: Mar. 6, 1997

[51] Int. Cl.[6] ..... B67D 5/06

[52] U.S. Cl. ..... 222/185.1; 222/146.6

[58] Field of Search ..... 222/185.1, 146.6; 215/42, 382

[56] References Cited

U.S. PATENT DOCUMENTS

| | | | |
|---|---|---|---|
| 2,155,259 | 4/1939 | Dickson | 183/49 |
| 3,688,950 | 9/1972 | Parish | 222/146.6 |
| 3,848,776 | 11/1974 | Schieser | 222/185.1 |
| 4,635,824 | 1/1987 | Gaunt et al. | 222/129.1 |
| 4,723,688 | 2/1988 | Munoz | 22/185.1 |
| 4,741,448 | 5/1988 | Alley et al. | 222/185.1 |
| 5,086,950 | 2/1992 | Crossdale et al. | 222/88 |
| 5,297,700 | 3/1994 | Burrows et al. | 222/146.6 |
| 5,402,915 | 4/1995 | Hogan | 222/185.1 |
| 5,427,276 | 6/1995 | Knuettel, II et al. | 222/131 |

*Primary Examiner*—Joseph A. Kaufman

*Attorney, Agent, or Firm*—Sixbey, Friedman, Leedom & Ferguson; David S. Safran

[57] ABSTRACT

An improved water bottle design for use with a water cooler type bottled water dispensing apparatus is provided in which the water bottle includes a horizontal surface area positioned around the base of the neck of the bottle, where the bottle contacts an annular opening of the housing above an open end of a reservoir portion of the housing of the bottled water dispensing apparatus. This flat horizontal surface area results in greater stability for the water bottle on the housing than can be achieved with conventional bottles which engage the annular opening of the housing at a vertically curved surface of the bottle. Moreover, no special adapters or couplings are necessary to produce an interfit between the water bottle and the housing, and therefore, the improved stability is achieved in a very simple manner. In second and third embodiments, the water bottle further includes a transition region that is substantially perpendicular to the horizontal surface area and may contact with an interior periphery of the bottle-receiving opening of the housing. By contacting with the interior periphery, the transition region further provides for a tighter fitting of the water bottle to the housing, so that the inverted bottle seats with greater stability on the housing without increasing the complexity of the overall structure as the case for the use of special adapters or couplings.

9 Claims, 4 Drawing Sheets

WATER BOTTLE FOR WATER COOLER TYPE DISPENSING APPARATUS

BACKGROUND OF THE INVENTION

1. Field of the Invention

This invention relates to water bottles for use with bottled water dispensing apparatus that receive a water bottle in an inverted position, and more specifically to an improvement for increasing the stability of the water bottle on the dispensing apparatus.

2. Description of Related Art

Bottled water dispensing apparatus, commonly referred to as "water coolers", have been widely used in many settings including office buildings, homes, restaurants, to supply clean drinking water, etc. The water dispensing apparatus normally includes a apparatus housing having an upwardly open reservoir which receives and supports a water bottle that is placed on the open reservoir in an inverted manner. Water is then selectively dispensed from the reservoir using a faucet valve or tap on the front of the apparatus housing.

U.S. Pat. Nos. 2,155,259 and 5,297,700 both depict the general placement of a water bottle on the housing of a water cooler type dispensing apparatus. Unfortunately, problems arise from the manner in which the water bottle is placed in an inverted manner on the reservoir. The bottle is precariously balanced on an annular edge of a bottle receiving opening of the housing, and in many instances, any bumping of the bottle or apparatus housing causes the bottle to tilt, or possibly even fall off of the apparatus housing, which may cause injury to those around the apparatus either from the bottle or from any water spilling on the ground. Moreover, it is difficult to keep the bottle level while it is inverted, and therefore the bottle may sit in a tilted position, which increases the possibility of the bottle tipping over with a slight bumping of the bottle or the apparatus housing.

A typical solution used to combat this problem has been to use specialized adapters that aid in providing a tighter fit of the bottle to the apparatus housing. U.S. Pat. No. 3,688,950 to Parish shows one example of a typical adapter member that retrofits into existing water dispenser apparatus, wherein the adapter includes a supporting plate and a plug member. In addition, the Parish invention utilizes a specialized bottle bag structure disposed in a paper carton that has a spout for carrying water from the bag to the water reservoir and apparatus housing. The Parish structure, however, has the problem that it involves the use of specialized adapter members which are complicated and therefore increase the cost of the water dispensing apparatus. In addition, using a more complicated structure generally results in a greater likelihood of having mechanical problems, such as a tubular portion of the spout springing a leak. Therefore, higher overall maintenance costs are likely to result with such structures. Furthermore, only the specialized water containers disclosed in the Parish reference can be used with the Parish structure, and such containers may not be widely available.

U.S. Pat. Nos.5,086,950, 4,635,824, and 5,427,276 all depict alternative adapters and couplings that may be used to support liquid containers on dispensing apparatus. Overall, these patents indicate that the typical solution to the problem of having the water bottle precariously balanced on the housing has been to use specialized adapters and the like to provide a tighter fit of the water bottle to the apparatus housing. Unfortunately, problems of increased structural complexity and a higher incident of mechanical problems has lead to a need for a simplified solution to the problem of water bottles falling off the dispenser apparatus which will not increase the overall complexity of the water dispensing apparatus and which will apply to existing apparatus' without modification thereof.

SUMMARY OF THE INVENTION

In view of the above-noted problems, it is an object of the present invention to provide an improved water bottle that will stably support itself on the housing of a bottled water dispensing apparatus.

It is another object of the present invention to provide an improved water bottle design that can stably support itself on the housing of a bottled water dispensing apparatus without requiring modification of the overall bottled water dispensing apparatus, so that it may be used.

It is a further object of the present invention to provide an improved water bottle design that will stably support itself on the housing of a bottled water dispensing apparatus without use of special adapters or couplings.

These and other objects that will become apparent in the following description are achieved in accordance with preferred embodiments of the invention. In particular, in a first embodiment of the invention, an improved water bottle design for use with a water cooler type bottled water dispensing apparatus is provided wherein the water bottle includes a horizontal surface area positioned around the base of the neck of the bottle, where the bottle contacts an annular opening of the housing above an open end of a reservoir portion of the housing of the bottled water dispensing apparatus. This flat horizontal surface area results in greater stability for the water bottle on the housing than can be achieved with conventional bottles which engage the annular opening of the housing at a vertically curved surface of the bottle. Moreover, no special adapters or couplings are necessary to produce an interfit between the water bottle and the housing, and therefore, the improved stability is achieved in a very simple manner.

In second and third preferred embodiments of the invention, the water bottle further includes a transition region that is substantially perpendicular to the horizontal surface area and may contact with an interior periphery of the bottle-receiving opening of the housing. By contacting with the interior periphery, the transition region further provides for a tighter fitting of the water bottle to the housing. Therefore, the inverted bottle seats with greater stability on the housing without increasing the complexity of the overall structure as the case for the use of special adapters or couplings.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
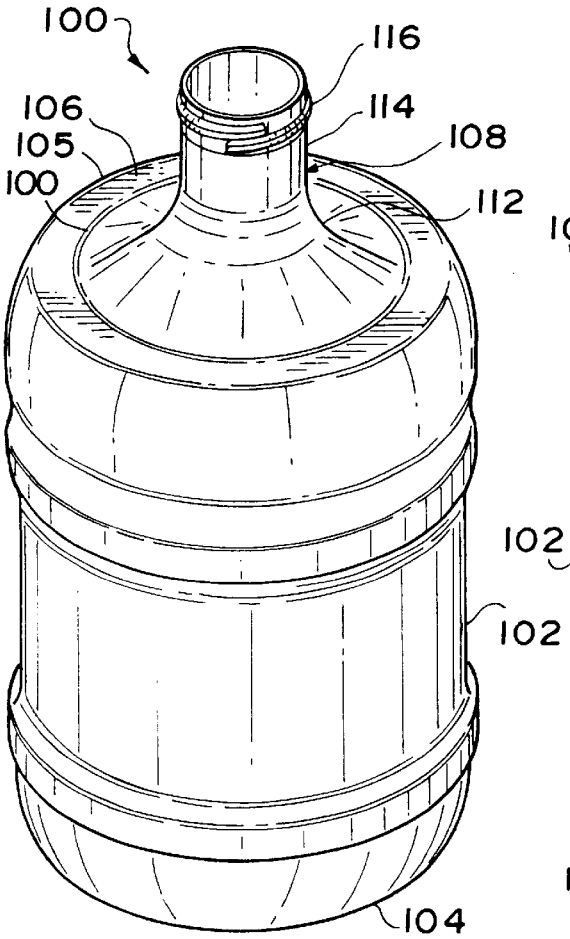
FIG. 1 is a perspective view as seen from above of an improved water bottle in accordance with a first embodiment of the present invention.
Figure 2:
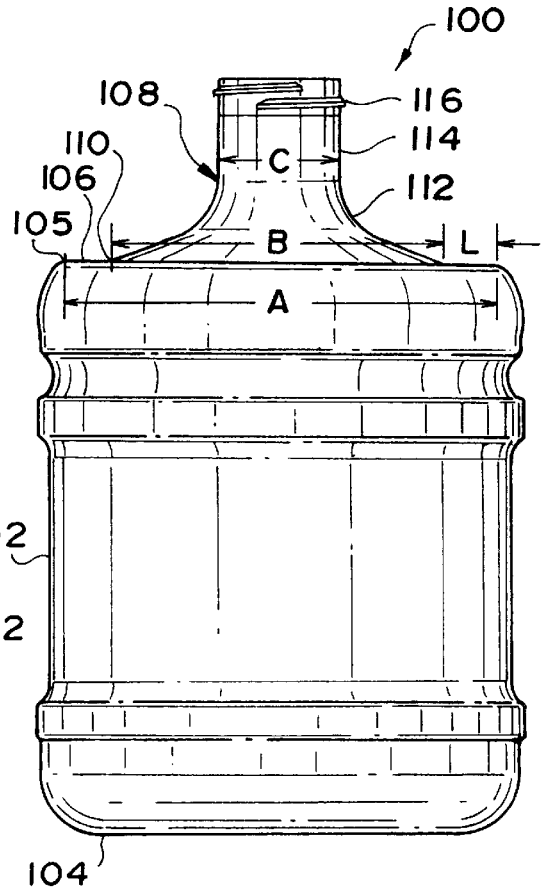
FIGS. 2–4 show, respectively, elevational, top plan, and bottom plan views of the improved water bottle in accordance with the first embodiment of the present invention.
Figure 3:
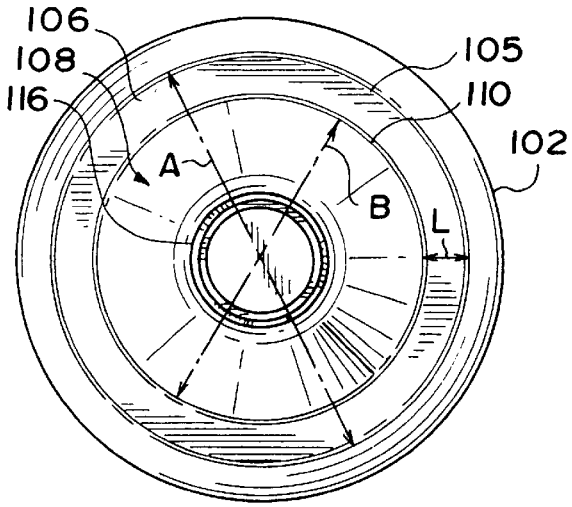
Figure 4:
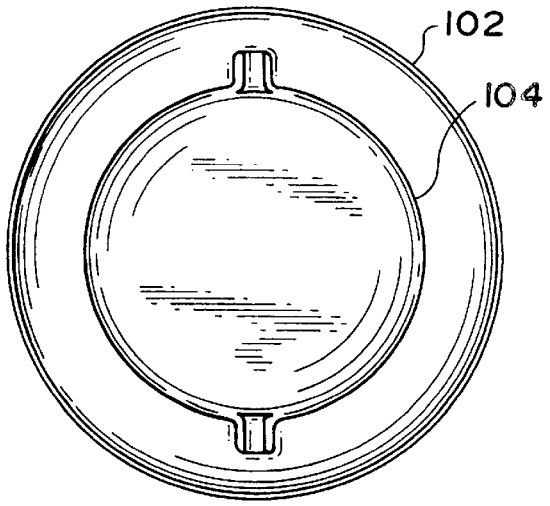

FIGS. 1–4 shows an improved bottle 100, in accordance with a first embodiment of the present invention, for use, as described below relative to FIG. 11, with a water cooler type dispensing apparatus. Water bottle 100 comprises a hollow container body 102, a bottom wall 104, a top wall 106, and a neck 108. It should be noted that the hollow container body 102 and bottom wall 104 may be given any shape, that illustrated merely being one suitable example. In this first preferred embodiment, top wall 106 is substantially flat and horizontal with an outer diameter A and an inner diameter B, yielding a radial length L. A base 110 of neck 108 is disposed at an inner diameter B of top wall 106 and starting at this base 110, the neck 108 has a first region 112 that substantially continuously decreases in diameter, tapering away from hollow container body 102. This tapered first region 112 ends at a second region 114 which has a substantially constant diameter C, at a top portion of which threads 116 are provided for a cap (not shown).

Figure 11:
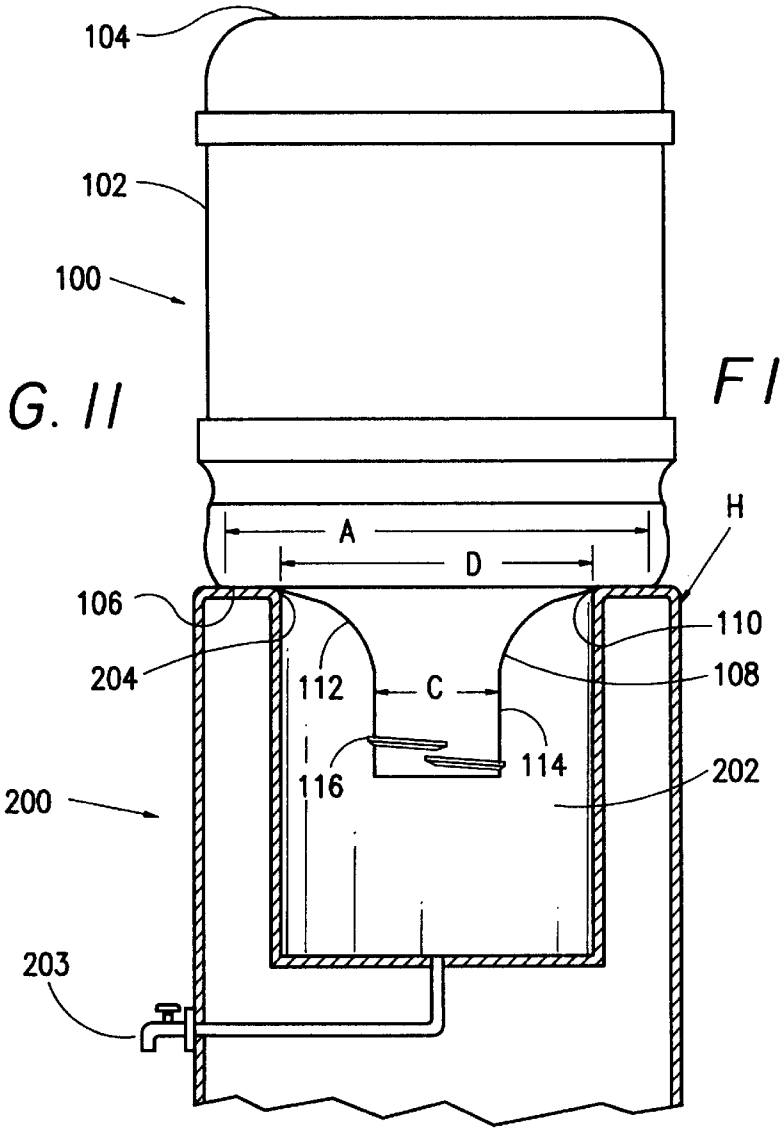
FIG. 11 is a schematic illustration of the improved water bottle of the first embodiment seated on a water dispensing apparatus.

Referring now to FIG. 11, water bottle 100 of the first embodiment is shown as placed on a water dispensing apparatus 200. While any conventional structure for the water dispensing apparatus 200 may be used, FIG. 11 depicts a water dispensing apparatus 200 that includes a housing H within which a water reservoir 202 is provided for temporarily holding water before it is dispensed using faucet 203. The open upper end 204 of water reservoir 202 receives the neck 108 of water bottle 100 when the water bottle 100 is placed in an inverted manner on the housing of the dispensing apparatus 200.

The particular placement of water bottle 100 on the housing H extending into the upper end 204 reservoir 202 will now be discussed. The upper end 204 of reservoir 202 has a diameter D that is larger than the inner diameter B of the top wall 106, but is less than outer diameter A of top wall 106. Therefore, when water bottle 100 is placed upside down on the housing H of water dispensing apparatus 200 the tapered neck 108 is located within the upper end 204 with the bottle 100 resting on housing H via its substantially flat top wall 106.

This arrangement advantageously provides a greater contact area between the water bottle 100 and dispensing apparatus 200 as compared to conventional bottle designs where the bottle rests on the dispensing apparatus along a rounded shoulder of the bottle (see FIG. 1 of U.S. Pat. Nos. 2,155,259 and 3,688,950). This increase in contact area provides greater stability for water bottle 100 on housing H. It should be noted that the substantially flat top wall 106 must have a length L that is long enough to taking into account variations in diameter D from one dispensing apparatus to another while insuring that the contact area created by top wall 106 is provides sufficient stability. For this reason, this length L is preferably between 0.1 and 1 inch long for a half-gallon bottle. Of course, any length sufficient to accomplish the goal of increased contact with open upper end 204 may be used instead, further depending on the capacity of the water bottle desired in a particular application or the requirements of a particular dispensing apparatus.

In addition, the substantially flat contact surface of top wall 106 better maintains a level supporting of water bottle 100 on open upper end 204 over conventional designs where it is difficult to maintain the water bottle 100 at a purely level position due to the manner in which it rests, noted above. With the present invention, slight movement of water bottle 100 or dispensing apparatus 200 will not upset the level positioning of water bottle 100. Thus, water bottle 100 is unlikely to be tilted, and is even less likely to be knocked over because of the improved stabilized supporting of the water bottle 100 on the dispensing apparatus 200.

Figure 5:
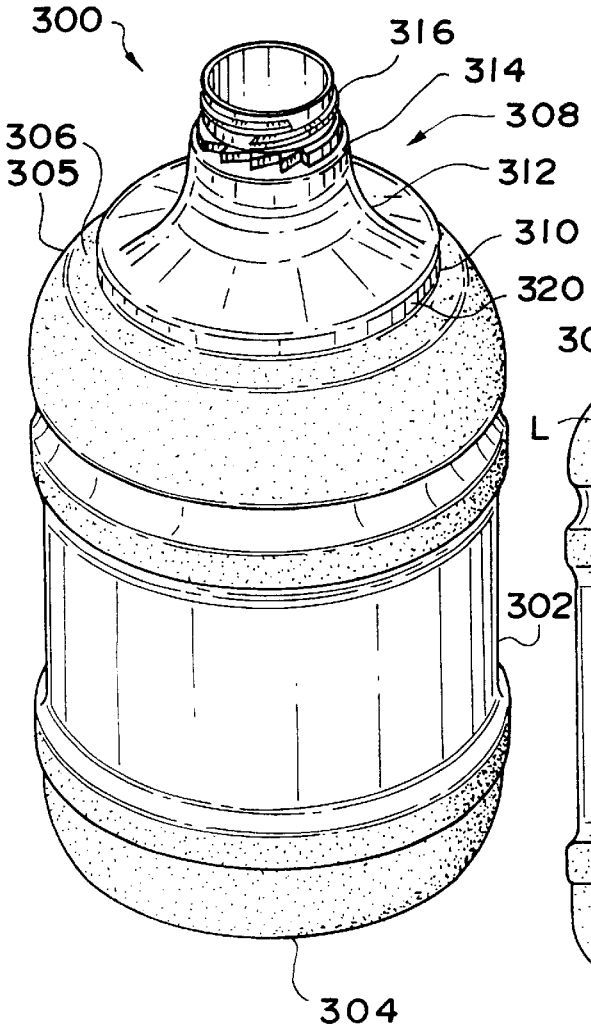
FIGS. 5–7 views corresponding to FIGS. 1–3, respectively, but show an improved water bottle in accordance with a second embodiment of the present invention.
Figure 6:
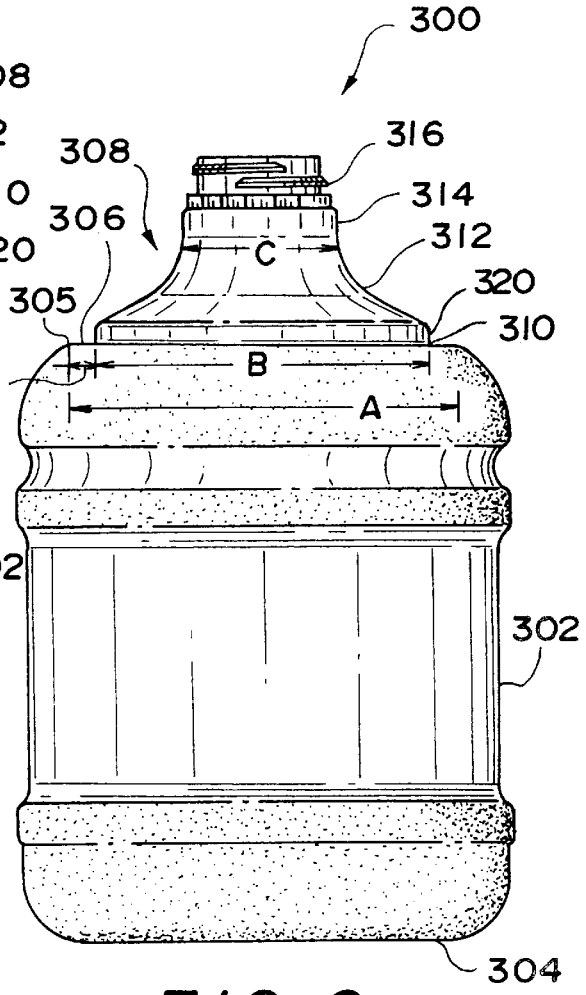
Figure 7:
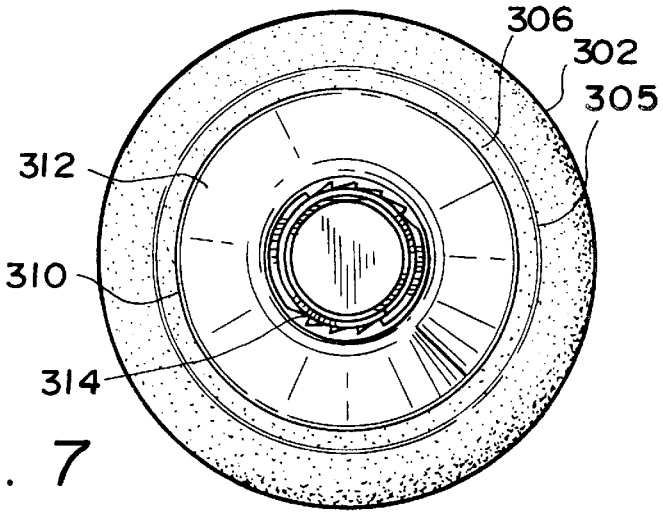

FIGS. 5–7 show an improved water bottle 300 in accordance with a second embodiment of the present invention. The overall structure of water bottle 300 of the second embodiment is very similar to the structure of water bottle 100 of the first embodiment so that parts of bottle 300 which correspond to parts described above relative to bottle 100 have been given the same reference number increased by a 200 (e.g., container body 302 corresponds to container body 102, etc.). Thus, in the following, only the distinctions between the two embodiments will be forwarded upon. In this regard, the key difference between water bottle 300 and water bottle 100 is a cylindrical transition region 320 is provided between the throated neck 308 the body of water bottle 300. This transition region 320 is substantially perpendicular to the substantially flat top wall 306. In FIGS. 5–7, the transition region 320 is positioned directly adjacent to the substantially flat top wall 306, but this is not necessary. In addition, due to the inclusion of transition region 320, first region 312 is formed on top of transition region 320 rather than directly adjacent to base 310.

Figure 12:
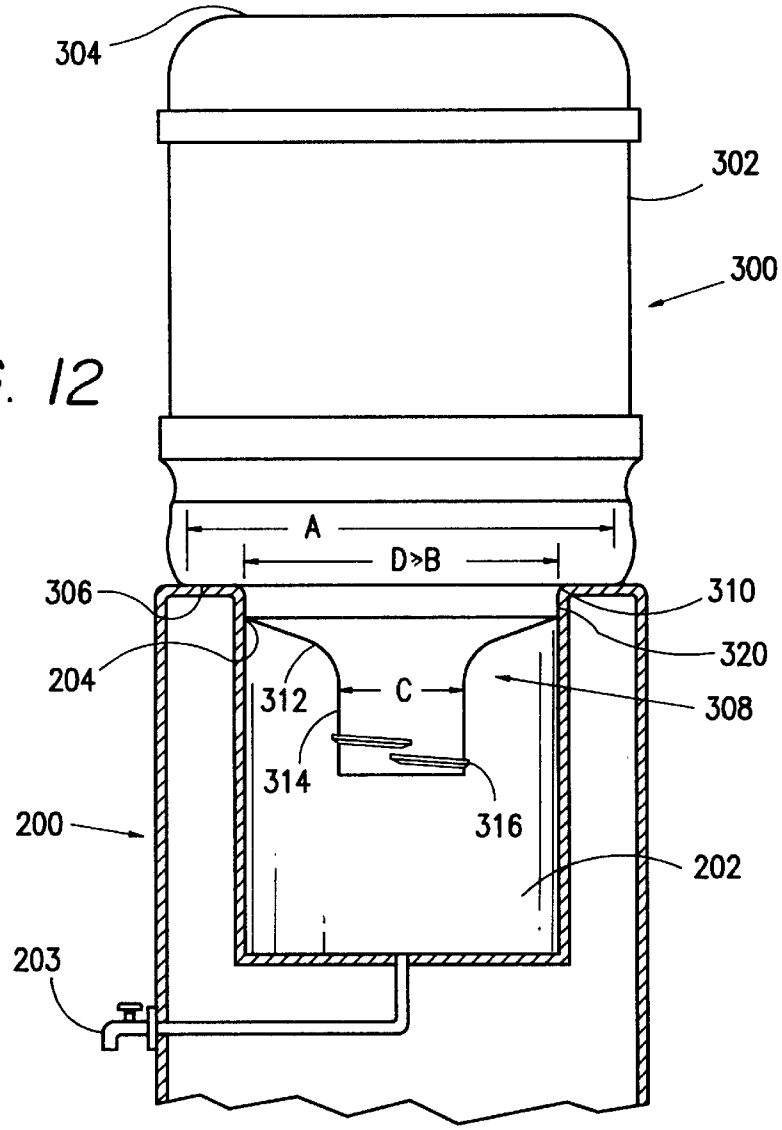
FIG. 12 is a schematic illustration of the improved water bottle of the second embodiment seated on a water dispensing apparatus.

The purpose of transition region 320 relates to the seating of water bottle 300 on water dispensing apparatus 200 as will be clear from the following together with FIG. 12, where water bottle 300 is shown placed on the water dispensing apparatus 200. The placement of water bottle 300 onto dispensing apparatus 200 is very similar to the placement of water bottle 100 on dispensing apparatus 200 except in the case of bottle 300, transition region 320 has a diameter B that is less than diameter D of the open upper end 204 so that, when the water bottle 300 is placed on the dispensing apparatus 200, transition region 320 seat with the open upper end 204 of water reservoir 202.

The main advantage of the transition region 320 is that it further improves stabilizes the water bottle 300 on the water dispensing apparatus 200. Transition region 320 increases contact area of water bottle 300 with dispensing apparatus 200 and helps prevent water bottle 300 from tipping over or moving horizontally, i.e., in a side-to-side manner. This feature, in addition to the substantially flat top wall 306, increases the secureness with which the water bottle 300 seats on the water dispensing apparatus 200. Furthermore, as in the first embodiment, this embodiment eliminates the need for any special adapters or couplings to achieve a stable positioning of the water bottle on a water dispensing apparatus.

Figure 8:
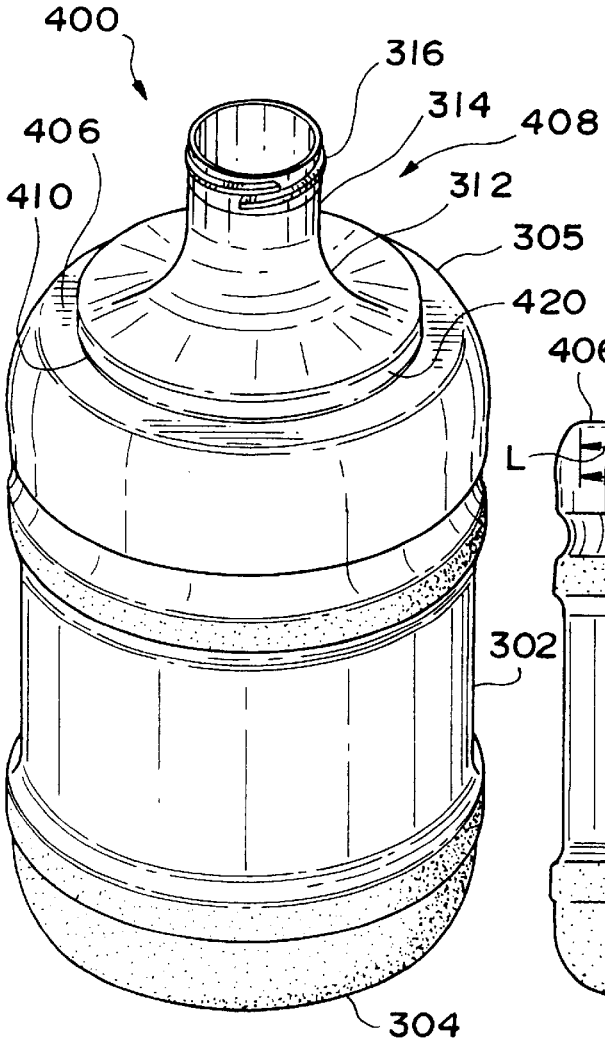
FIGS. 8–10 are views corresponding to FIGS. 1–3, respectively, but show an improved water bottle in accordance with a third embodiment of the present invention.
Figure 9:
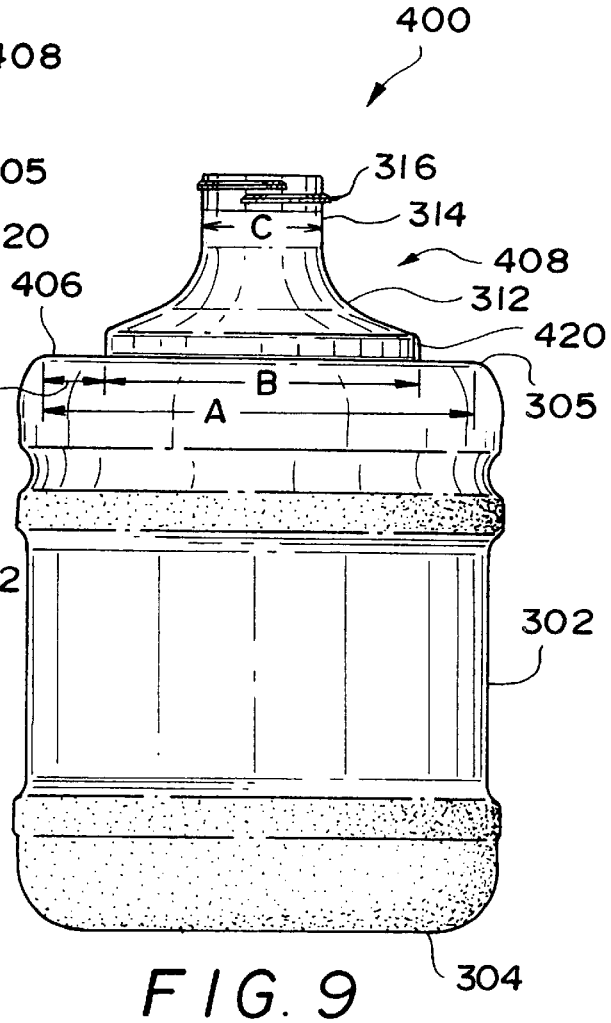
Figure 10:
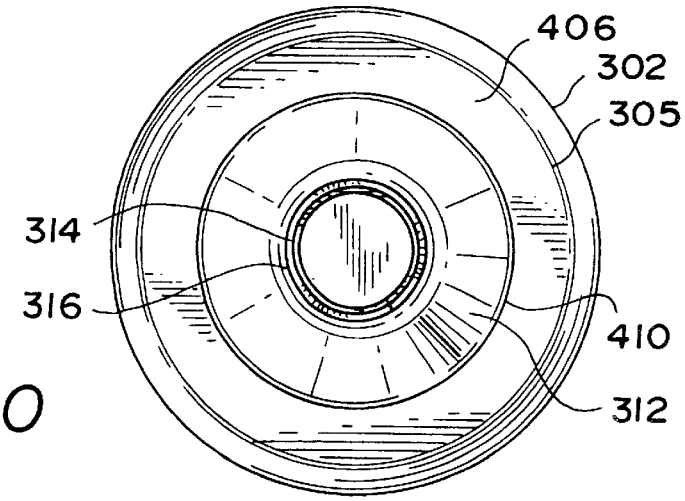

FIGS. 8–10 show a third embodiment of the present invention. This third embodiment is very similar to water bottle 300 of the second embodiment and like reference numerals increase by 100 (e.g., container body is 402 instead of 302) have been used for similar parts. The third embodiment illustrates that a neck 408 and cylindrical transition 420 may be utilized which thereby increasing the radial extent of the substantially flat top wall 406 relative to top wall 406 of the second embodiment. It should be noted that any size diameter neck 408 may be used as long as it has a diameter less than diameter D of open upper end of the water dispensing apparatus shown in FIGS. 11 & 12. 204. Likewise, the disposition of cylindrical transition 420 may be varied in a particular application such that transition region 420 fits securely with the inner periphery of the water reservoir of a particular water dispensing apparatus.

While the present invention has been shown and described herein in what is conceived to be the most practical and preferred embodiments, it is recognized that departures may be made within the scope of the invention, which is not to be limited to the details disclosed herein but is to be accorded the full scope of the claims so as to embrace any and all equivalent apparatus and articles.

We claim:

1. A container for use with a water dispensing apparatus of the type in which a housing has an open upper end with an opening positioned over a reservoir portion, said container comprising:

a hollow container body having a substantially flat top wall, said substantially flat top wall having an outer diameter greater than a diameter of the opening of said upper end of the housing; and a neck connected to said hollow container body radially inwardly of said flat top wall, said neck comprising a base having a diameter that is less than said diameter of the said opening, wherein the base of the neck is connected to the inner diameter of the substantially flat top wall by an abrupt transition, and wherein said substantially flat top wall seats upon the upper end of the housing portion with said neck extending through the opening in the upper end and with the abrupt transition seating with the opening when said container is placed on the dispensing apparatus.

2. The container of claim 1, wherein said substantially flat top wall has a radial length, between said outer diameter and said base of said neck between 0.1 and 1.0 inch.

3. The container of claim 1, wherein said container is formed of blow molded plastic.

4. The container of claim 1, wherein said container is provided with an opening at a top of said neck for filling an interior space of said hollow container body with a liquid and for pouring of a liquid therefrom.

5. The container of claim 4, wherein said opening is closable by a cap.

6. The container of claim 1, wherein said base is positioned directly adjacent to an inner diameter of said substantially flat top wall.

7. The container of claim 1, wherein said transition extends substantially perpendicular to said substantially flat top wall.

8. The container of claim 7, wherein said transition region is sized for contacting an inner wall of the upper end when said container is placed on the dispensing apparatus.

9. The container of claim 7, wherein said container is formed of blow molded plastic.

* * * * *